United States Patent [19]

Kitajima

[11] 3,950,725

[45] Apr. 13, 1976

[54] AUTOMOBILE DETECTING AND ANNOUNCING DEVICE

[76] Inventor: Masaichi Kitajima, 12-18 Imazu-Yamanaka-cho, Nishinomiya; Hyogo, Japan, 662

[22] Filed: July 25, 1975

[21] Appl. No.: 599,068

[52] U.S. Cl. ..... 340/31 R; 340/51; 360/12

[51] Int. Cl.[2] ..... G08G 1/02; G08G 1/09

[58] Field of Search ..... 340/31, 39, 51, 38 R, 221; 179/100.41; 360/12; 40/53 A

[56] References Cited

UNITED STATES PATENTS

| | | | |
|---|---|---|---|
| 2,325,435 | 7/1943 | Sykora | 340/31 R |
| 3,126,522 | 3/1964 | Fieser | 340/39 |
| 3,319,222 | 5/1967 | Grant et al. | 340/38 |
| 3,409,745 | 11/1968 | Kock | 360/12 |
| 3,431,553 | 3/1969 | Osmond | 340/31 R |
| 3,588,808 | 6/1971 | Gustus | 340/41 |

*Primary Examiner*—Donald J. Yusko
*Attorney, Agent, or Firm*—Eugene E. Geoffrey, Jr.

[57] ABSTRACT

Apparatus for detection of the presence of an automobile and its direction of movement into and out of a specific area and activating a reproducing system to provide audible and/or visual information to the driver and then resetting the system upon completion of the reproduction.

1 Claim, 2 Drawing Figures

AUTOMOBILE DETECTING AND ANNOUNCING DEVICE

This invention relates to an improved automatic automobile detecting and announcing device.

When an automobile is to enter or leave a specific place, such as a hotel, gas station, parking area or toll road, it is preferable to make necessary announcements such as greetings, requests, weather and road conditions, alarms and the like, to the driver of the automobile in oral and/or visual form. Heretofore, there was no means for carrying out these operations automatically and they have been done manually as the occasion demands or by fixed or semipermanent indications.

Accordingly, an object of this invention is to provide a device for detecting an automobile entering or leaving a specific place and automatically activating corresponding sound and/or visual information reproducing systems.

According to this invention, the device comprises a pair of fluid-containing resilient hoses disposed in substantially parallel relationship one to the other on and across a road, a discriminating circuit including a pair of pressure-responding switches coupled respectively to said hoses and actuated by changes of the internal pressures of said hoses, said discriminating circuit having two outputs and discriminating the direction of movement of said automobile from the order of actuation of said switches to produce a signal from one of said outputs, a pair of information reproducing systems coupled respectively to said outputs for reproducing stored information in response to said signal supplied from said discriminating circuit, and a restoring circuit for sensing completion of the reproducing operation of said reproducing systems and restoring said discriminating circuit to its original "ready" condition.

Figure 1:
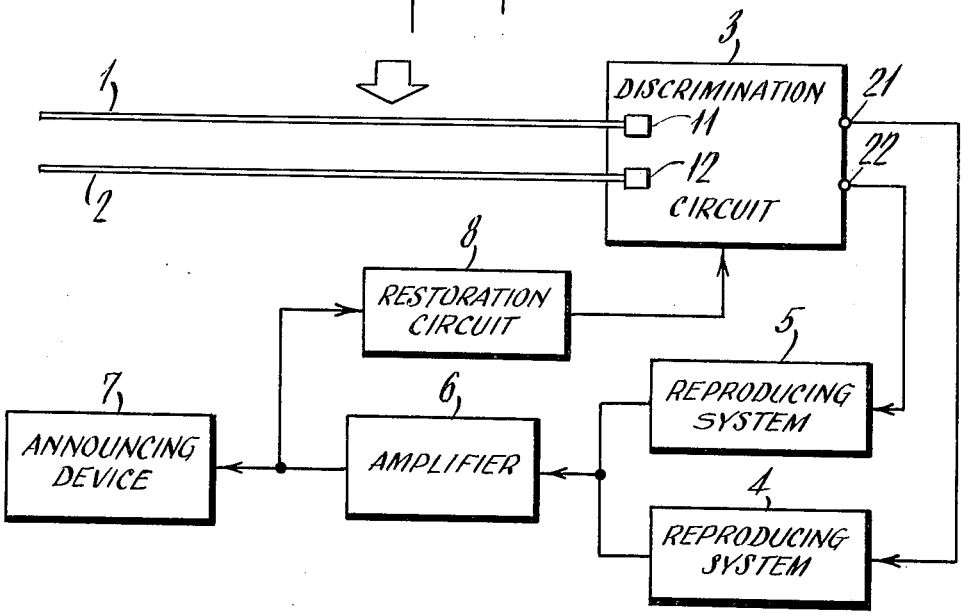
Figure 2:
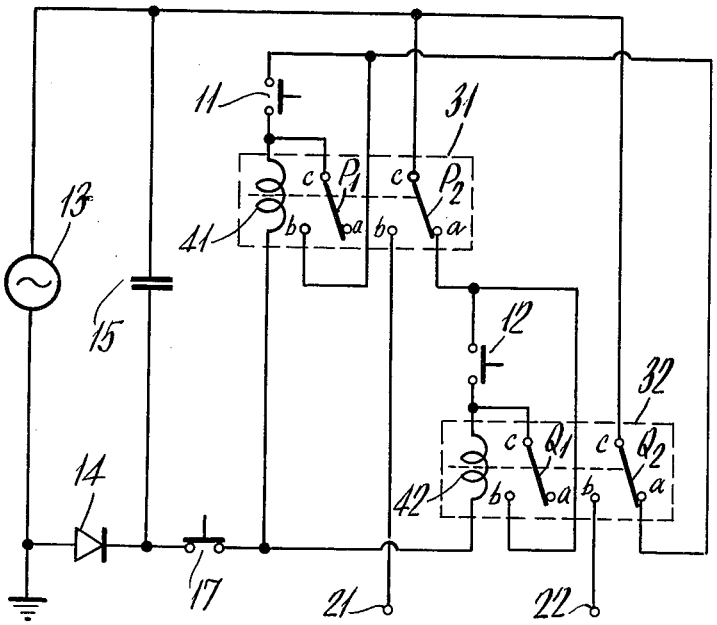

Other objects and features of this invention will be described in detail hereinunder with reference to the accompanying drawings, in which:

FIG. 1 is a schematic block diagram representing a circuit configuration of an embodiment of the device of this invention; and FIG. 2 is a circuit diagram representing a discrimnation circuit embodied in the device of FIG. 1.

Throughout the drawings, like reference numerals are used to denote corresponding components.

Referring now to FIG. 1, a pair of resilient hoses 1 and 2 made of rubber or the like and filled with air or fluid are disposed in parallel across the entrance or gate of a specific place on the road. The hoses 1 and 2 are respectively provided at one end with pressure-responsive switches 11 and 12 which are included in a discrimination circuit 3. The discrimination circuit 3 has a pair of ouput terminals 21 and 22 connected respectively to first and second information reproducing systems 4 and 5. The outputs of the information reproducing systems 4 and 5 are coupled through an amplifier 6 to an adequate information announcing device 7 such as a loud speaker and/or luminous indication. The output of the amplifier 6 is also connected to a restoration circuit 8 having an output coupled back to the discrimination circuit 3.

When an automobile enters the gate in the direction of the arrow and treads on the hose 1 first, the switch 11 is actuated first and the discrimination circuit 3 discriminates the incoming an automobile and produces an output from the terminal 21 as described in detail later with reference to FIG. 2. Thus, the information reproducing system 4, which stores information for incoming drivers, is actuated to reproduce the stored information, and the reproduced information is audibly and/or visually announced from the announcing device 7. When the reproduction is completed, the restoration circuit 8 senses the completion from the output of the amplifier 6 and supplies a restoration signal to the discrimination circuit 3 to restore it to its original ready condition as described later.

Referring next to FIG. 2, the discrimination circuit 3 of this embodiment includes an a.c. source 13, a rectifier 14 and a smoothing capacitor 15 connected in a closed circuit. The junction of the rectifier 14 and capacitor 15 is connected through a normally-closed contact 17, which is temporarily opened by a signal from the restoration circuit 7, to one end of the field windings 41 and 42 of first and second electro-magnetic relays 31 and 32 as shown in dashed blocks. The first relay 31 includes two single-pole double-throw switches $P_1$ and $P_2$ and the second relay 32 includes also two similar switches $Q_1$ and $Q_2$. The other ends of the windings 41 and 42 are respectively connected through normally-open switches 11 and 12, which correspond respectively to the pressure-responsive switches 11 and 12 in FIG. 1, to the normally-open contacts *b* of the switches $P_1$ and $Q_1$ and also to the normally-closed contacts a of the switches $Q_2$ and $P_2$, respectively, as shown in the drawings. The wiper terminals *c* of the switches $P_1$ and $Q_1$ are connected respectively to one terminal of the switches 11 and 12, while the wiper terminals *c* of the switches $P_2$ and $Q_2$ are connected in common to the junction of the a.c. source 13 and capacitor 15. The normally-closed contacts *a* of the switches $P_1$ and $Q_1$ are left floating. Although all of the switches in the electromagnetic relays 31 and 32 are shown as single-pole double-throw switches for convenience of description, it is clear that the switches $P_1$ and $Q_1$ may be single-pole single-throw switches.

In the above ready condition, if the switch 11 is closed first by an automobile passing in the direction of the arrow as shown in FIG. 1, a closed circuit including the source 13 and the winding 41 is completed and the relay 31 is energized to close the normally-open contacts *b* of the switches $P_1$ and $P_2$. Thus, the switch $P_1$ forms a self-sustaining circuit of the relay 31 to maintain it in the energized condition. At the same time, due to closure of the contact *b* of the switch $P_2$, the source voltage appears at the terminal 21 and is applied to the reproducing system 4 as described heretofore with reference to FIG. 1. Although the switch 12 is closed by the same automobile after closure of the switch 11, nothing occurs since a closed circuit is not formed thereby as the contact *a* of the switch $P_2$ has already been opened.

When the reproduction of information has been completed by the reproducing system 4 and the output of the amplifier 6 ceases, the restoration circuit 8 senses it and produces a restoration signal. The normally-closed switch 17 is opened temporarily by this signal to break the closed circuit including the winding 41. Thus, the relay 31 is de-energized and the circuit is restored to the original ready condition.

It should be easy for those skilled in the art to understand that a similar operation is carried out through the output terminal 22 and the reproducing system 5 when the switch 12 is first closed by an automobile passing the gate in a direction opposite to the foregoing arrow of FIG. 1.

Although, in the above embodiment, the restoration signal is obtained from the output of the amplifier 6 through the restoration circuit 8, it can be obtained in other ways, such as, by detecting an end mark previously put on the recording tape or film used in the information reproducing systems 4 and 5 for indicating completion of the reproduction.

If there are two or more gates or entrances in a specific place, the pressure-responsive switches provided for these gates in correspondence to the switches 11 and 12 may be connected in parallel to the switches 11 and 12, respectively.

What is claimed is:

1. An automatic automobile detecting and announcing device, comprising a pair of fluid-containing resilient hoses disposed substantially parallel to each other on and across a road, a discriminating circuit including a pair of pressure-responsive switches coupled respectively to said hoses and actuated by changes of the internal pressures of said hoses, said discriminating circuit having two outputs and discriminating the direction of movement of an automobile from the order of actuation of said switches to produce a signal from one of said outputs, a pair of information reproducing systems coupled respectively to said outputs for reproducing stored information in response to said signal supplied from said discriminating circuit, and a restoring circuit for sensing completion of the reproducing operation of said reproducing systems and restoring said discriminating circuit to its original ready condition.

* * * * *